US005902183A

United States Patent [19]

D'Souza

[11] Patent Number: 5,902,183

[45] Date of Patent: May 11, 1999

[54] PROCESS AND APPARATUS FOR ENERGY CONSERVATION IN BUILDINGS USING A COMPUTER CONTROLLED VENTILATION SYSTEM

[76] Inventor: Melanius D'Souza, 1718 Avenida Entrada, San Dimas, Calif. 91773-4314

[21] Appl. No.: 08/969,629

[22] Filed: Nov. 13, 1997

Related U.S. Application Data

[ 60] Provisional application No. 60/030,928, Nov. 15, 1996.

[51] Int. Cl.[6] ..... F24F 7/00

[52] U.S. Cl. ..... 454/258; 236/49.3

[58] Field of Search ..... 454/258; 236/46 R, 236/49.3

[56] References Cited

U.S. PATENT DOCUMENTS

| | | | |
|---|---|---|---|
| 3,934,494 | 1/1976 | Butler . | |
| 4,196,848 | 4/1980 | Falkenstein | 236/46 R |
| 4,251,026 | 2/1981 | Siegel et al. | 236/46 R |
| 4,477,020 | 10/1984 | Makara | 236/46 R X |
| 4,602,739 | 7/1986 | Sutton, Jr. . | |
| 4,697,736 | 10/1987 | Kolt | 236/49.3 |
| 4,838,345 | 6/1989 | Dolison et al. | 236/49.3 X |
| 5,000,381 | 3/1991 | Mueller et al. | 236/49.3 X |
| 5,364,026 | 11/1994 | Kundert | 236/49.3 |
| 5,573,180 | 11/1996 | Werbowsky . | |

*Primary Examiner*—Henry Bennett
*Assistant Examiner*—Susanne C. Tinker
*Attorney, Agent, or Firm*—Melanius D'Souza

[57] ABSTRACT

A method and apparatus for conserving energy in buildings consisting of an indoor temperature sensor, an outdoor temperature sensor, a programmable electronic thermostat, and a bi-directional power ventilator. The programmable electronic thermostat contains software instructions to switch on or switch off the power ventilator during predetermined time schedules in response to changes in the indoor and the outdoor temperatures. During a summer day-time schedule, the thermostat switches on the power ventilator in the normal flow mode to exhaust the building of hot accumulated indoor air if the indoor temperature is greater than a selected set-point temperature and if the indoor temperature is also greater than the outdoor temperature by a predetermined ratio. During a summer night-time schedule, the thermostat switches on the power ventilator in the reverse flow mode to force cooler outdoor air into the warm building if the indoor temperature is greater than a selected set-point temperature and if the indoor temperature is also greater than the outdoor temperature by a predetermined ratio. During a winter day-time schedule, the thermostat switches on the power ventilator in the reverse flow mode to force warmer outdoor air into the cold building if the indoor temperature is less than a selected set-point temperature and if the indoor temperature is also less than the outdoor temperature by a predetermined ratio. The use of cooler summer night-time air to pre-cool the building during warm summer days reduces the air-conditioning energy requirements of the building during the summer. The use of warmer winter day-time air to warm the cold building during cold winter days reduces the space heating energy requirements of the building during the winter.

20 Claims, 6 Drawing Sheets

PROCESS AND APPARATUS FOR ENERGY CONSERVATION IN BUILDINGS USING A COMPUTER CONTROLLED VENTILATION SYSTEM

BACKGROUND-CROSS—REFERENCE TO RELATED APPLICATIONS

This is a regular (non-provisional) patent application which claims priority from the provisional patent application Ser. No. 60/030,928 filed on Nov. 15, 1996.

BACKGROUND—FIELD OF THE INVENTION

The invention described herein generally relates to a process and apparatus for minimizing the consumption of energy in buildings using a computer controlled ventilation system. Specifically, it relates to the operation of commonly used gable or roof ventilation systems (for example, those using a gable fan or a roof fan in a residential, commercial, warehouse or manufacturing building) for maximum energy conservation. The invention can also be applied to commonly used uni-directional and bi-directional (reverse air) window fans. The invention will be particularly useful in warm dry desert-type climates like in Southern California, Nevada, Arizona, etc. where the average summer day-time temperature is much higher than the average summer night-time temperature.

BACKGROUND—DISCUSSION OF PRIOR ART

Attic fans, gable fans, exhaust fans, and whole house fans are known and are used in homes and buildings to control the building's interior ambient temperature and humidity. Window fans are also used for this purpose. All of these kinds of fans are readily available at major hardware suppliers within the US. For purposes of this description of the invention, attic fans, gable fans, exhaust fans, whole house fans, window fans and the like will be generally referred to as power ventilators (PVs). Some kinds of contemporary PVs (CPVs) like attic, and gable fans are usually equipped with a bi-metallic thermostat which activates the fan based on the interior temperature of the dwelling. Prior art regarding power ventilators and thermostats is described in U.S. Pat. No. 3,934,494 to Butler (1976).

The '494 Butler patent describes a power ventilator attached to a roof for ventilating an attic or the like. Operation of the Butler power ventilator is controlled by a thermostat which operates the fan when the temperature in the attic exceeds a first predetermined temperature and disengages the fan when the temperature falls below a second predetermined temperature. The Butler power ventilator is also equipped with a fire control switch to prevent operation of the ventilator in case of fire in the dwelling or the attic. The Butler power ventilator only operates when the daytime interior temperature inside the building exceeds the set-point temperature on the thermostat. It then evacuates the dwelling of accumulated hot air. Typically, the CPV begins to operate when the temperature inside the attic reaches about 100° F. and ceases to operate when the attic temperature drops to about 85 degrees Fahrenheit. The set points at which the CPV starts to operate can be manually adjusted by the user.

The above mode of operation is standard with all contemporary attic and gable fans which are equipped with bimetallic thermostats. On the other hand, exhaust fans, whole house fans, and window fans are generally operated by manually switching the fan on when the temperature inside the building is judged to be excessive. Thus the major limitation of contemporary power ventilators equipped with automatic bi-metallic thermostats is that they only operate on hot days after the building has already been heated by solar radiation. Similarly, the major limitation of CPVs without automatic thermostats is that they have to be manually switched on when the temperature is excessive. As a result of the above modes of operation, contemporary power ventilators (CPVs) only start to evacuate the dwelling of hot air after the building has already become hot because of solar radiation. The hot air inside the building is replaced with outside ambient air which is still relatively warm because the CPV only starts to operate during the mid-day hours after the building has already been heated up by solar radiation. The operation of the power ventilator is supposed to reduce the temperature inside the dwelling which in turn is supposed to reduce the consumption of electrical energy for air-conditioning the dwelling. However the reduction is marginal because the CPV only reduces the temperature inside the building to about 10 degrees above the outside ambient temperature. Thus the air-conditioning system still has to operate to reduce the dwelling indoor temperature from this relatively high temperature to a more comfortable level. The CPV does not exploit the fill potential of the ventilator to reduce the average overall temperature of the dwelling during hot summer days by taking advantage of lower ambient temperatures during summer nights. This reduction of average dwelling temperature to greatly reduce the air-conditioning energy requirements of the dwelling is the goal of the present invention.

Another effect of the limited operation of CPVs in manufacturing buildings is that the average temperature inside the building is higher than the maximum outdoor ambient temperature because the CPV is generally only operated during mid-day hours when the outside air temperature is relatively high. This reduces the productivity of the workers in the manufacturing building. The goal of the present invention is to increase the productivity of the workers during summer-time by providing an average indoor temperature which is lower than the maximum outdoor temperature. This goal is accomplished by operating the PV to pre-cool the building during the nighttime so that it takes a longer time to heat up during the daytime.

In contrast to the power ventilator described in the Butler patent which is only responsive to the indoor temperature, a power ventilator which is responsive to the outdoor temperature is described in U.S. Pat. No. 4,602,739 to Sutton, Jr. (1986). The Sutton system is used to maintain optimum temperature and humidity conditions in animal enclosures like those used for the breeding of poultry. The Sutton system consists of an outdoor temperature sensor operatively connected to a cycle timer to operate a ventilator for a variable percentage of time during consecutive given time intervals. A controller is used, in cooperation with the outdoor temperature sensor and the cycle timer, to automatically vary the percentage of fan operation time during each given time interval in response to temperature changes in the outside air such that constant minimum ventilation efficiency is maintained within the enclosure. An optional indoor temperature sensor is also provided to override the outdoor temperature sensor to ensure that the temperature within the enclosure remains within desired limits. The Sutton invention only minimizes the usage of the power ventilator to reduce the amount of ventilation that is required in the animal enclosure. Thus instead of the ventilator constantly ventilating the air from the enclosure, it only ventilates it for intermittent periods of time. The intermittent operation increases the energy usage efficiency of the enclosure resulting in increased production of poultry. The controlling variable in the Sutton invention is the outdoor temperature only. The indoor temperature is not used as a controlling variable; it is only used to override the outdoor temperature sensors and to operate the PV when the temperature inside the enclosure is considered to be excessive even though it is less than the outdoor temperature.

U.S. Pat. No. 5,573,180 to Werbowsky (1996) describes a protective thermostat which is used to protect a building from freezing. The thermostat monitors the indoor air temperature indicated by the thermostat's indoor air temperature sensor to check if it is within a pre-defined valid range. If the monitored temperature is outside this pre-defined range, the thermostat proceeds to read the outdoor temperature and activate a heating system if the outdoor air temperature is below a pre-defined range. The device is used as a protective measure only; it is not used for energy conservation. Also it is only used to heat the building; it is not used for pre-cooling the building during summer-time and heating the building during winter-time by taking advantage of the temperature difference between the indoor and outdoor air temperatures.

The major disadvantage of contemporary power ventilators as described in the Butler patent is that they are idle during summer nights which are generally the coolest part of the day. Operation of the power ventilator during summer nights can greatly reduce the average daily temperature inside the building resulting in a large reduction in electrical energy for air conditioning purposes. CPVs are also idle during winter days when the ambient temperature outside the building is generally higher than the ambient temperature inside the building which has cooled down during the nighttime. In such a situation, ambient air from outside can be drawn into the building with the aid of the power ventilator to increase the temperature inside the building. Thus the winter heating energy requirements of the building will be reduced. Contemporary power ventilators also have the disadvantage of not being capable of integration into a computerized energy management system because they are incapable of providing suitable output signals to a computer.

The other disadvantage of contemporary power ventilators is that they are equipped with bi-metallic thermostats which are not very accurate. Thus the actual operating temperature of the PV may vary quite a bit from the set-point. The thermostats on CPVs also do not have a read-out. Therefore, there is no way of reading the temperature on these thermostats.

In view of all the above disadvantages of CPVs, the general purpose of the present invention is to utilize power ventilators in a more intelligent manner than is presently the case. This can be done by using the PV to pre-cool the building during summer by replacing the hot air trapped inside the building with lower night-time ambient air. Compared to the CPV, the present invention will greatly reduce the air-conditioning energy requirement during the day-time. Similarly, the present invention can also be used to warm the building during winter days to save on space heating energy requirements.

OBJECTS AND ADVANTAGES

Accordingly, it would be advantageous to provide an improved power ventilator for homes and other buildings which would pre-cool the interior of the building during hot summer days by circulating cooler ambient air through the building during the night-time. It would also be advantageous to provide an improved power ventilator for homes and other buildings which will also heat up the interior of the building during winter days by circulating warmer air from outside the building.

Therefore, several objects and advantages of the present invention are:

a. to provide an intelligent ventilation system which is capable of greater conservation of electrical energy for air-conditioning purposes than is possible with CPVs;
b. to provide an intelligent ventilation system which is capable of conserving space heating energy requirements during winter days;
c. to provide an intelligent ventilation system which is capable of being programmed to meet the user's temperature control needs;
d. to provide an intelligent ventilation system which can be integrated into a building's computerized energy management system;
e. to provide a way to retrofit existing power ventilators to increase energy savings;
f. to provide an energy conservation system which will greatly increase worker productivity during hot summer days and cold winter days; and
g. to provide an inexpensive means of controlling indoor ambient temperature and reducing air-conditioning costs.

These and other objects are achieved by the present invention which preserves the advantages of using the power ventilator on hot summer days and further increases its energy conservation potential by using it to pre-cool the building during summer nights. These advantages are primarily realized by replacing the bi-metallic thermostat presently used in CPVs by a solid state programmable controller. Programmable controllers have long been used with heating and ventilation systems. However, it is not believed known to have used such a system in connection with a power ventilator. Furthermore, the use of a programmable controller in cooperation with a power ventilator to monitor and control an indoor temperature based the continuous monitoring of indoor and outdoor temperatures is also not known.

According to one embodiment of the invention, the energy conservation system includes an indoor temperature sensor for sensing the temperature of air inside the building, an outdoor temperature sensor for sensing the temperature of ambient air outside the building, a programmable electronic thermostat which receives the sensed temperature signals from the two temperature sensors and a temperature control output device for exchanging air between the indoor and outdoor of a building. The programmable thermostat is programmed with a set of time schedules which define a summer day-time schedule, a summer night-time schedule, and a winter day-time schedule. The programmable thermostat reads the temperatures from the two temperature sensors and executes a series of computer software steps to determine if the temperature control output device is to be switched on or off. Thus the programmable thermostat switches on the temperature control output device during warm summer days to exhaust the building of accumulated warm air so that the average indoor temperature inside the building is reduced. This reduces the air-conditioning energy required for cooling the building.

In another embodiment of the invention, the programmable thermostat switches on the temperature control output device during summer nights to replace the accumulated warm air inside the building with cooler nighttime outside air. Thus the building is pre-cooled during the summer night so that it takes a longer time to warm up during the hot summer day. This has the effect of further reducing the air-conditioning energy required for cooling the building during warm summer days.

In yet another embodiment of the invention, the programmable thermostat switches on the temperature control output device during winter days to replace the accumulated cold air inside the building with warmer daytime outside air. Thus the building is warmed up during the winter day so that it takes a longer time to cool down during the cold winter night. This has the effect of reducing the energy required for space heating the building during the winter season.

In yet another embodiment of the invention, the temperature control output device comprises of a uni-directional flow power ventilator which is used to exhaust air from the building.

In a further embodiment of the invention, the temperature control output device comprises of a bi-directional flow (reverse flow) power ventilator which is used to exhaust air from the building during warm summer days and to force air into the building during summer nights and winter days. This increases the efficiency of the system.

In accordance with the method of the invention, ventilation in a building having an electric power supply and a temperature control output device is accomplished according to the steps of sensing the indoor temperature, sensing the outdoor temperature, and providing means to operate the temperature control output device in response to seasonal time schedules and changes in the indoor and outdoor air temperatures.

Still further objects and attendant advantages will become apparent from a consideration of the ensuing description and drawings which describe the various components of the current and proposed temperature control output system.

BRIEF DESCRIPTION OF THE DRAWING

The novel features which are characteristic of the present invention are set forth in the appended claims. The invention itself, however, together with further objects and attendant advantages, will be best understood by reference to the following description taken in connection with the accompanying drawings, in which:

Figure 1:
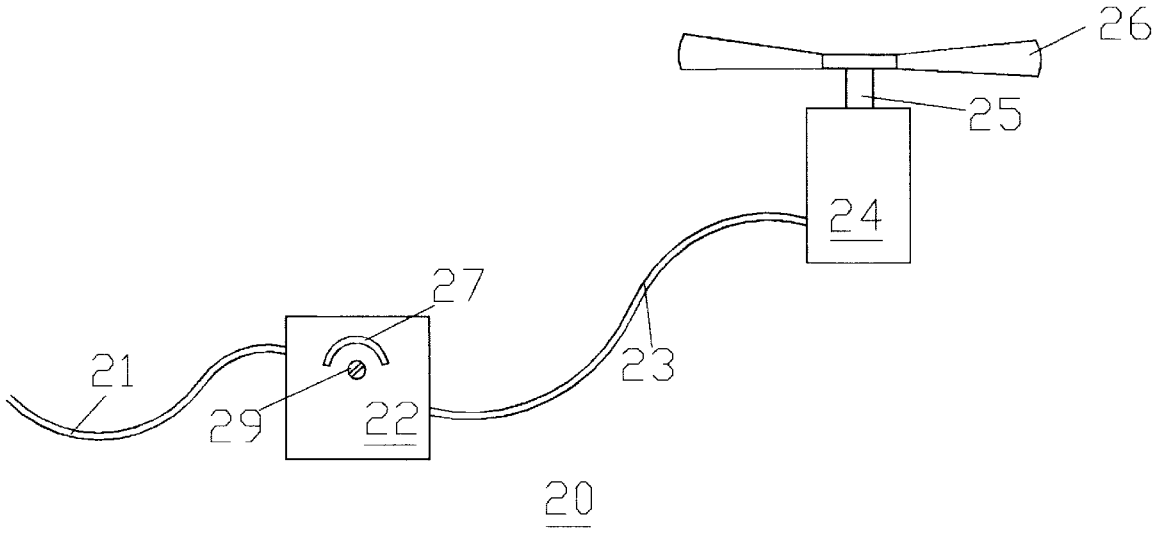
FIG.1 PRIOR ART
FIG. 1 is a representation of a CPV.

| Reference numerals in drawings | |
|---|---|
| 20 contemporary power ventilator (CPV) | 36 analog-digital convertor |
| 21 first electric power supply cable | 37 electrical bus |
| 22 bi-metallic thermostat | 38 microprocessor or CPU |
| 23 second electric power supply cable | 39 Read Only Memory (ROM) circuit |
| 29 temperature dial | 40 Operating software |
| 27 temperature range scale | 41 System Clock |
| 24 electric motor | 42 LCD display |
| 25 motor shaft | 43 input key-pad |
| 26 ventilator blades | 44 TRIARC or Solid State Relay (SSR) |
| 31 outdoor temperature sensor | 45 electric contact |
| 32 indoor temperature sensor | 45R reverse electric contact |
| 33 temperature sensor wires from 31 to 35 | 46 electric motor |
| 34 temperature sensor wires from 32 to 35 | 60 parameter input statement block 60 |
| 35 lead terminals on analog-digital convertor | 62 date/time read statement block |
| 64 temperature read block | 81 ENTER key |
| 66 summer date comparison block | 83 cursor keys |
| 67 summer time comparison block | 90 keypad |
| 68 summer day time temperature comparison block | 92 user interface |
| 69 summer night-time temperature comparison block | 82 indoor temperature comparison block (summer night-time) |
| 70 winter date comparison block | 84 indoor temperature comparison block (winter day-time) |
| 72 winter daytime comparison block | 100 power ventilator on-off check block |
| 74 winter daytime temperature comparison block | 102 indoor temperature comparison block (summer day-time) |
| 76 action block to activate the ventilator in normal flow mode | 104 summer night-time comparison block |
| 76R action block to activate the ventilator in reverse flow mode | 200 typical dwelling with attic |
| 78 de-energize solid state relay block | 202 living areas of typical dwelling 200 |
| 80 mode selection key | 204 attic of typical dwelling 200 |
| | 206 roof of typical dwelling 200 |
| | 201 present invention |

DESCRIPTION—FIGS. 1 TO 11

FIG. 1 shows a typical embodiment of a CPV system which is generally designated as 20. The CPV 20 includes a first electric power supply cord 21, a bimetallic strip thermostat 22 which has a temperature dial 29 and a temperature range scale 27, and a second electric power supply cord 23 which connects the thermostat 22 to the ventilator's electric motor 24. The cord 21 is connected to a power supply which provides the electrical energy to turn the motor 24. The rotor of the electric motor is operatively connected to the ventilator's blades 26 by means of a shaft 25. The dial 29 is rotatable until the desired set point is reached on the temperature range scale 27. In one model of the CPV, the set point recommended by the manufacturer is 85 degrees Fahrenheit. In this particular model of the CPV, the thermostat is an adjustable FAN-OFF switch. When the dial is set, the ventilator will shut off at the set temperature. The ventilator is designed to start at 15 degrees Fahrenheit above this setting (i.e. at 100° F.). However, other models of the CPV could have FAN-ON switches which switch on the ventilator at the set point and switch off the ventilator at a pre-determined temperature above the set point.

Figure 5:
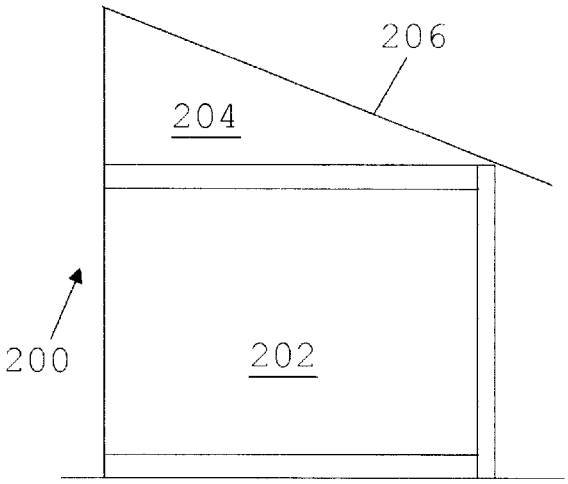
PRIOR ART FIG. 5
FIG. 5 is a typical cross-sectional representation of a building with an attic without a PV.
Figure 6:
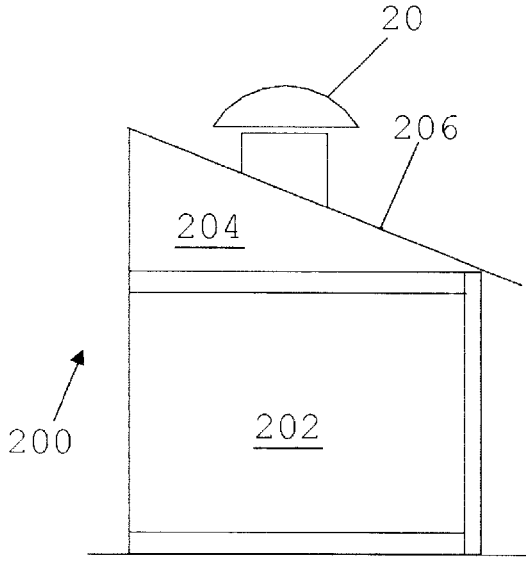
PRIOR ART FIG. 6
FIG. 6 is a typical cross-sectional representation of a building with an attic with a CPV during summer day-time operation.
Figure 7:
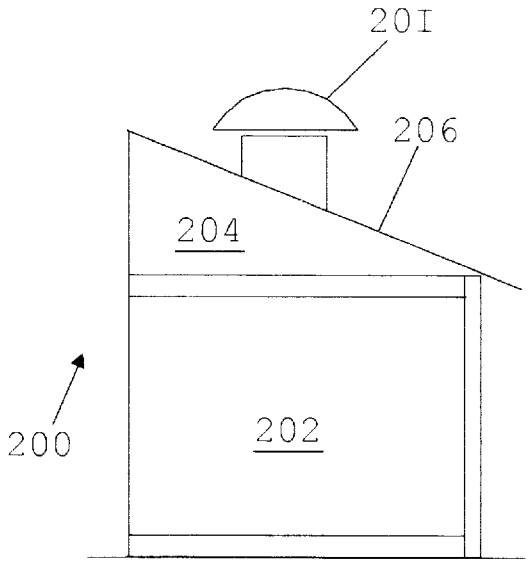
FIG. 7 is a typical cross-sectional representation of a building with an attic with the present invention during summer day-time operation.
Figure 8:
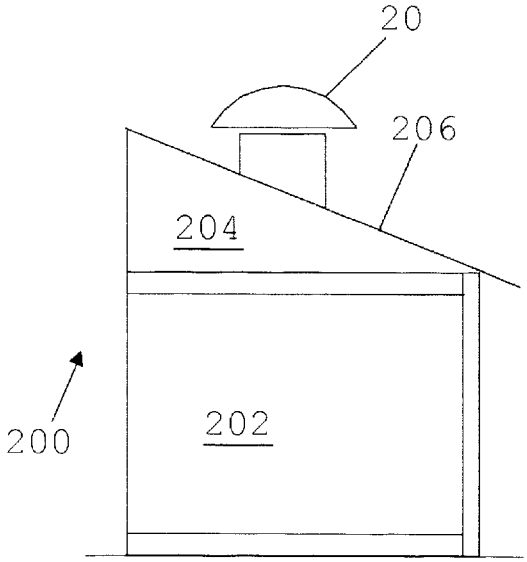
PRIOR ART FIG. 8
FIG. 8 is a typical cross-sectional representation of a building with a CPV during summer night-time operation.
Figure 9:
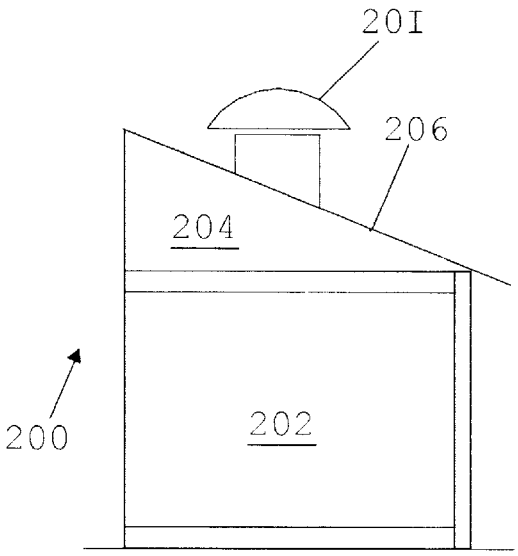
FIG. 9 is a typical cross-sectional representation of a building with an attic with the present invention during summer night-time operation.
Figure 10:
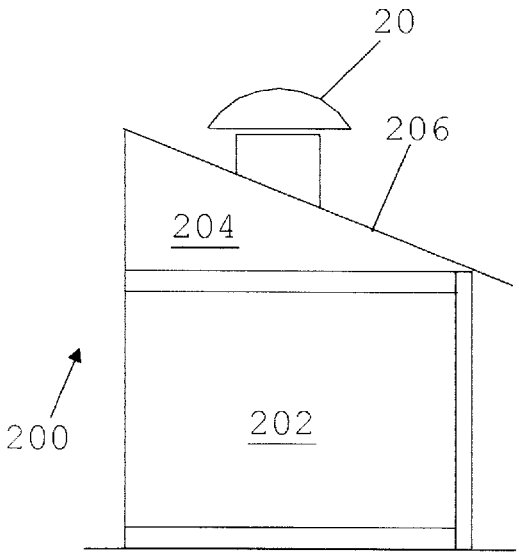
PRIOR ART FIG. 10
FIG. 10 is a typical cross-sectional representation of a building with an attic with a CPV during winter day-time operation.
Figure 11:
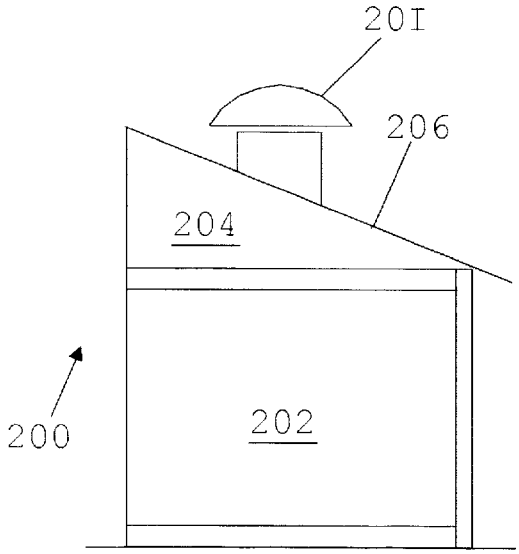
FIG. 11 is a typical cross-sectional representation of a building with an attic with the present invention during winter day-time operation.

FIG. 5 shows a typical temperature profile of a dwelling 200 with a living area 202 and an attic 204. This dwelling does not have a CPV and is consequently heated, by solar radiation, to about 150° F. in the attic 202 or 90° F. in the living areas 204. FIG. 6 shows a typical temperature profile of a dwelling 200, with a living area 202 and an attic 204, which has a CPV 20. The CPV exhausts the hot air from the attic 204 so that it is only heated, by solar radiation, to about 95° F.; this maintains a lower temperature of about 80° F. in the living areas 202. However, the living areas still have to be cooled down to about 65° F. by the air-conditioner to maintain a comfortable environment. FIG. 7 shows a typical temperature profile of a dwelling 200 with an attic 204 which has the present invention 201. In contrast to the dwelling with CPV shown in FIG. 6, the dwelling 200 is only heated, by solar radiation, to about 80° F. in the attic 204 and a more comfortable 70° F. in the living areas 202. Thus further cooling of the living area by an air-conditioner may not be necessary. FIG. 8 shows a typical summer night-time temperature profile of a dwelling 200 with an attic 204 which has a CPV 20. The day-time heat is trapped in the attic 204 which is only cooled down to about 85° F. by conduction with the cooler night-time ambient air. The living areas 202 are only cooled down to about 70° F. In contrast, as shown in FIG. 9, a dwelling 200 with the present invention 201 will, through operation of the present invention, be cooled down to 65° F. in the attic 204 while the living areas 202 will be maintained at a comfortable 68° F. FIG. 10 shows a typical dwelling 200 with a CPV 20 during winter-time. Since the CPV is not operated during the winter-time, the dwelling gets cooled, because of conduction of heat to the cold earth, to about 50° F. in the living area 202 and about 60° F. in the attic 204. In contrast, as shown in FIG. 11, a dwelling 200 with a CPV 201, will be maintained at a more comfortable 60° F. in the living area 202 because the attic 204 will be maintained at a higher temperature of 70° F. by the transfer of warmer day-time outdoor air into the cold attic 204. Therefore, less energy will be required for space-heating during the cold winter season.

DESCRIPTION—MAIN EMBODIMENT

Figure 2:
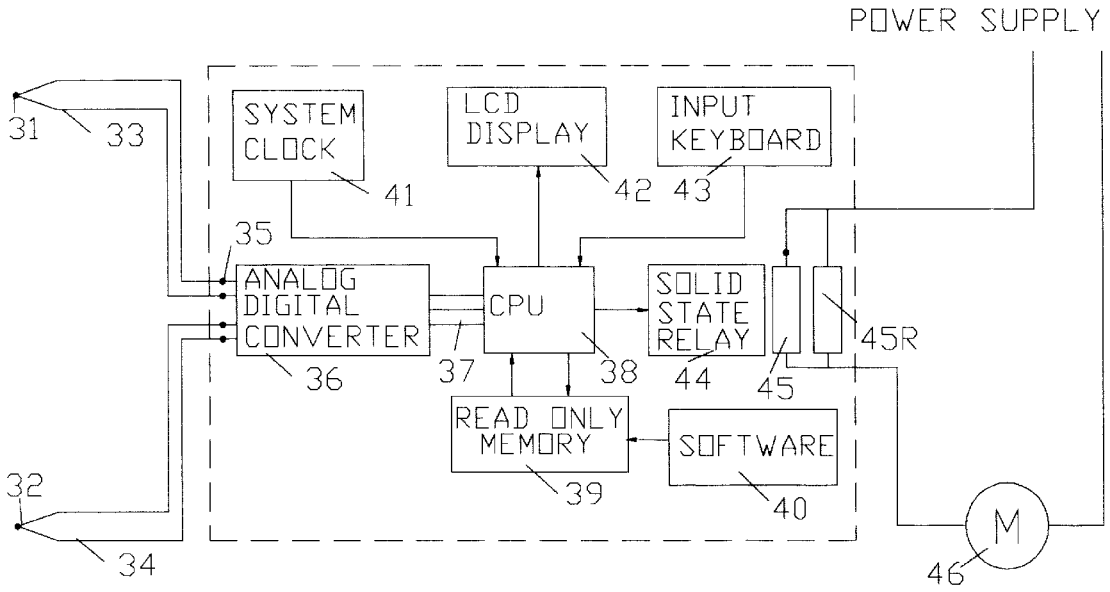
FIG. 2 is a representation of the preferred embodiment of the invention.

The preferred embodiment of the invention is shown in FIG. 2. The preferred embodiment describes two temperature sensors designated as 31 and 32 respectively. The temperature sensors could be thermocouples, thermistors, infra-red sensors, or any other transducers which respond to temperature. Temperature sensor 31 measures the ambient temperature outside the building while temperature sensor 32 measures the temperature inside the building. Temperature sensor 31 is operatively connected by temperature sensor wires 33 to an Analog to Digital Signal Converting Electronic circuit (A/D Converter) designated as 36 by means of lead terminals 35. Temperature sensor 32 is also operatively connected by temperature sensor wires 34 to lead terminals 35 of the A/D Converter 36. While FIG. 2 shows the transmission of the electrical signal generated by the thermocouple to be enabled by a solid conductor, it could also be enabled by wireless transmission means like radio frequency signals, infra-red signals, light signals, etc. The electronic circuitry describing the conversion of analog to digital signals is well known and widely available through manufacturers like Texas Instruments, Keithley Instruments, National Instruments, etc. Programmable thermostats are also well known and are readily available from manufacturers like Honeywell, Carrier, etc. The temperature sensors 31 and 32 measure temperature by generating an electrical current, generally in the 4 to 20 milliamp range. The A/D Convertor 36 transforms these 4 to 20 mA electrical signals into digital signals which are transmitted to a microprocessor or CPU 38 through an electrical bus 37. The CPU 38 is also operatively connected to a standard clock-calendar circuit or a system clock 41 which provides the time of day to the CPU 38. The CPU 38 is also operatively connected to a Read Only Memory (ROM) circuit 39 on which the software 40 for operating the power ventilation system is permanently embedded. The CPU 38 is also operatively connected to a LCD display 42 and an input key-pad 43 to enable the user to program the operation of the power ventilator. The digital signal from the CPU 38 is transmitted to a TRIAC or Solid State Relay (SSR) 44 which, depending on its state of activation, will either open or close the electrical contacts 45 and 45R. Contact 45 for all practical purposes is an on-off switch in series in the electric power supply to the ventilator's motor 46. The closing or opening of contact 45 enables electricity to flow or not flow to the motor 46 of the power ventilation system. The rotor of the motor 46 is operatively connected to the blades 26 of the ventilator by shaft 25 (not shown). Thus the rotation of the motor also rotates the ventilator's blades causing air to flow from the inside to the outside of the building and inducing cooler air to enter the building from the outside. The result is a cooling of the space 204 under the roof 206 which further results in a cooling of the living space 202 inside the building 200. Contact 45R is a reverse flow switch which reverses the rotation of the motor 36 so that air flows in the reverse direction i.e from outdoors to indoors. This results in a more efficient operation of the power ventilator than is possible by having a flow from indoors to outdoors only. Reversible switches for fans are commonly used in commercially available window fans and are well known in the art.

Figure 3:
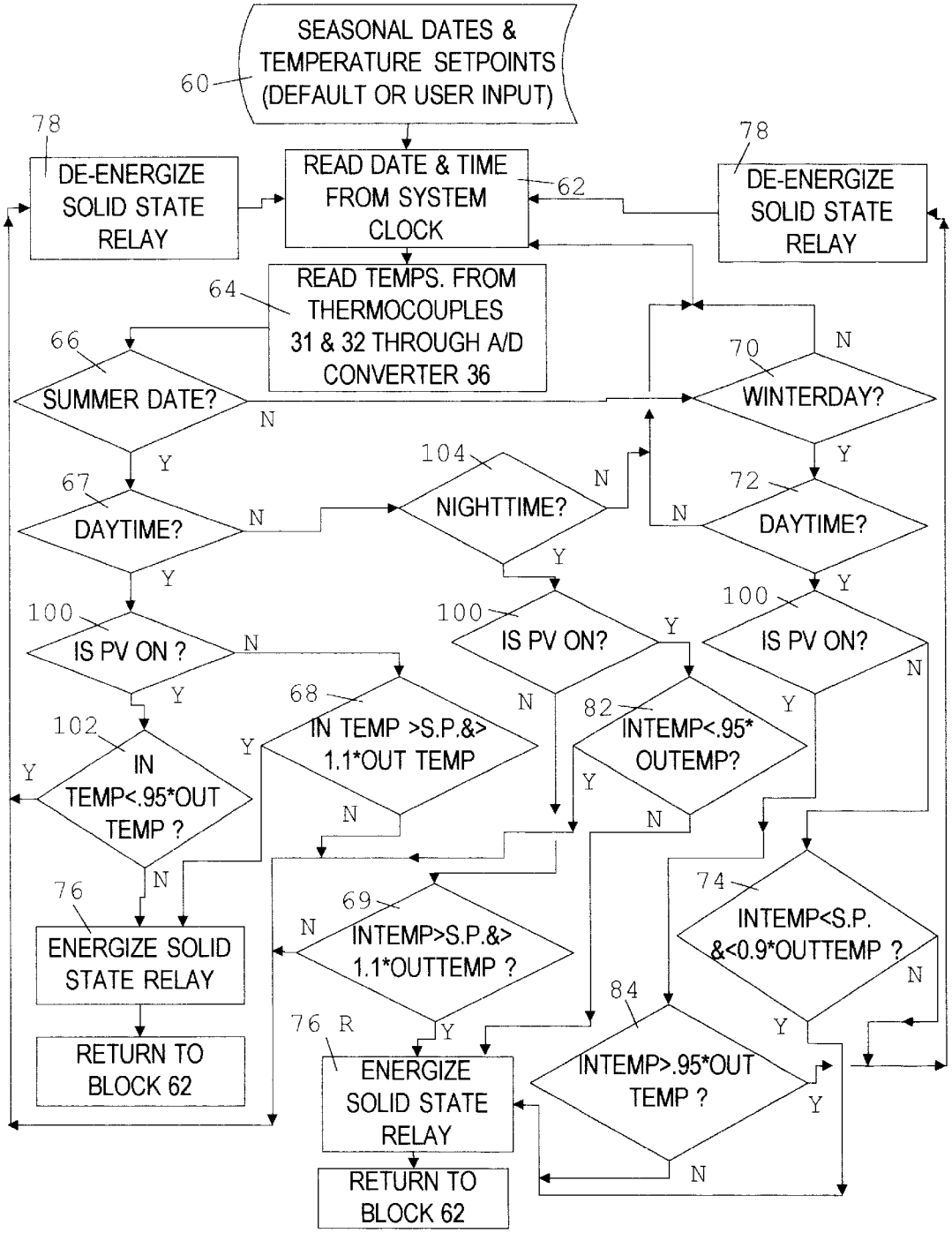
FIG. 3 is a flow-diagram of the software logic used in the programmable thermostat.

The logic describing the software 40 is shown in the flow-diagram in FIG. 3. The software consists of, but is not limited to the following software blocks:

- a parameter input (by using the keypad in the PROGRAM mode) statement block 60,
- a date/time read statement block 62,
- a temperature read block 64,
- a summer date comparison block 66,
- a summer day-time comparison block 67,
- a check PV on-or-off block 100,
- a summer day-time indoor/outdoor/set-point temperature comparison block 68,
- a summer day-time indoor/outdoor temperature comparison block 102,
- an action block to activate the power ventilator and/or other devices in normal flow mode 76,
- an action block to activate the power ventilator and/or other devices in reverse flow mode 76R,
- a summer night-time comparison block 104,
- a summer night-time indoor/outdoor/set-point temperature set-point comparison block 69,
- a summer night-time indoor/outdoor temperature comparison block 82,
- a winter date comparison block 70,
- a winter time comparison block 72,
- a winter daytime indoor/outdoor/set-point temperature comparison block 74,
- a winter daytime indoor/outdoor temperature comparison block 84,
- and a de-energize solid state relay block 78.

To simplify the flow diagram, software blocks 76R and 78 are each shown in two boxes. For the same reason, block 100 is also shown in three boxes.

Figure 4:
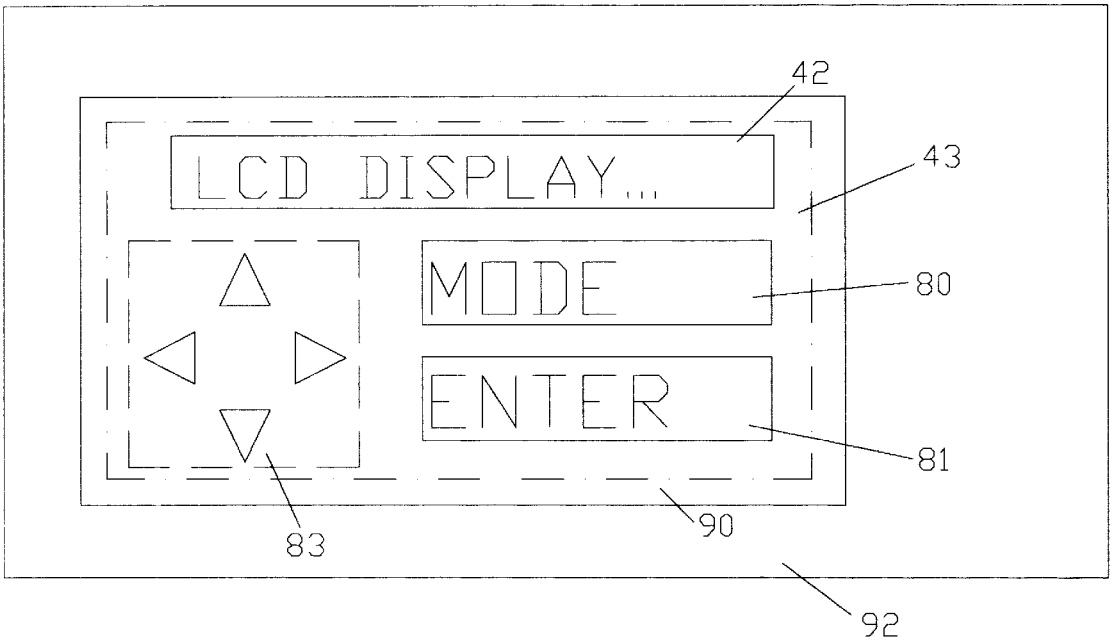
FIG. 4 is a representation of the user interface of the programmable thermostat.

FIG. 4 shows a simple embodiment of the control unit 92. The control unit 92 could be physically located either at the PV or at a remote location. It could also be located remotely from the other electronic circuitry like the CPU 38 and A/D convertor 36. The control unit 92 has a user interface 90 which consists of a cluster of input keys and a LCD display 42. The input keys consist of the MODE key 80, the ENTER key 81 and the cursor keys 83. The user interface 90 is equivalent to the key-board 43 shown in FIG. 1.

The MODE key 80 is used to change the mode of operation of the CPU 38 so that the default values can be edited or put into a normal operative mode. The ENTER key 81 is used to instruct the CPU 38 to accept the edited value during the default. The cursor keys 83 are used to scroll through the pre-programmed menu in the software and to edit the inputs. The user interface could also have an alphanumeric key pad to input or edit the set points. A clearer understanding of the use of the user interface keys will be evident from the following discussion of the operation of the PV.

OPERATION OF THE PREFERRED EMBODIMENT

The operation of the present invention is best understood from a discussion of the operation of the software program 40 shown in FIG. 3 in conjunction with the control unit 92 shown in FIG. 4. To set the operating parameters of the power ventilation system control unit, the user first presses the MODE button 80 on the user interface 90 of the control unit 92. The user interface 90 is equivalent to the key-board 43 shown in FIG. 1. This action puts the CPU 38 into a PROGRAM mode and causes the software block 60 to scroll through an item list which at least includes the following action items:

set clock-calendar
enter summer season starting date (SSSD)
enter summer season ending date (SSED)
enter winter season starting date (WSSD)
enter winter season ending date (WSED)
enter daytime starting time (DST)
enter daytime ending time (DET)
enter night-time starting time (NST)
enter night-time ending time (NET)
enter summer day-time temperature set-point (SDTSP)
enter summer night-time temperature set-point (SNTSP)
enter winter day-time temperature set-point (WDTSP)

Default values are provided in the software for the above, but the user is given the option to change them to reflect local conditions. To change the values of the defaults, the user presses the MODE key 80 on the user interface 90 of the control unit 92. The LCD display 42 shows that the CPU 38 is now in the EDIT mode. The software then guides the user through a menu of items including the default values shown above and prompts the user for changes. The user can either accept the default value by pressing the ENTER button 81 or input new values using the cursor keys 83 and pressing the ENTER button 81. Once the above parameters are input by the user, he/she presses the MODE button 81 again. The LCD display 42 shows that the CPU 38 is now in the RUN mode. The control unit 92 is now ready for normal operation.

During normal operation, the software block 62 reads the current date and time from the system clock 41. The software then executes software block 64 which reads the indoor and the outdoor temperatures from temperature sensors 31 and 32 through the A/D converter 36. The software then executes software block 66 where it compares the current date value read from the system clock 41 with the default or user input values for the summer season starting and ending dates. If software block 66 determines that the current date is within the beginning summer start and end dates, execution proceeds to software block 67; else it proceeds to software block 70. In software block 67, the software compares the current time to check whether it falls within the default or user defined starting and ending time for the daytime. If true, it then proceeds to software block 100, else it proceeds to software block 104. In software block 100, the software checks to see if the PV is on or off. If the PV is off, it branches off to block 68; else it branches to block 102.

In software block 68, the software compares the current indoor temperature to check if it is above the summer daytime temperature set-point and also if it is greater than the outdoor temperature by a fixed multiplier which is greater than or equal to 1. In this description, the multiplier is arbitrarily chosen to be 1.1 but it could be any value which will optimize the operation of the PV. If the comparison is true, the software will branch off to software block 76 wherein the CPU 38 is instructed to send a digital signal to the SSR 44 to close contact 45 to activate the PV motor 46 in the normal flow mode so that hot air is pulled out of the building and expelled outdoors. The software then loops back to block 62 where it re-starts the whole process of checking dates and times and temperatures. If the comparison is not true, the software will branch off to software block 78 wherein the CPU 38 is instructed to send a digital signal to the SSR 44 to open contact 45 to prevent the operation of the PV motor 46. From software block 78, the software then loops back to block 62 where it re-iterates the whole loop.

In software block 102, the software compares the current indoor temperature to check if it is less than the outdoor temperature by a fixed multiplier which is less than 1. In this description, the multiplier is arbitrarily chosen to be 0.95 but it could be any value which will optimize the operation of the PV. If the comparison is not true, the software will branch off to software block 76 wherein the CPU 38 is instructed to send a digital signal to the SSR 44 to close contact 45 to activate the PV motor 46 in the normal flow mode so that hot air is pulled out of the building and expelled outdoors. If the comparison is true, the software will branch off to software block 78 wherein the CPU 38 is instructed to send a digital signal to the SSR 44 to open contact 45 to cease the operation of the PV motor 46. From software block 78, the software then loops back to block 62.

Returning back to block 104, the software will check to see if the current time read from the system clock is night-time, otherwise it goes back to block 62. If true it proceeds to block 100, where it checks to see if the PV is on or off. If the PV is off, the software branches to block 69, otherwise it branches off to block 82. In software block 69, the software compares the current indoor temperature to check if it is above the summer daytime temperature set-point and also if it is greater than the outdoor temperature by a fixed multiplier which is greater than 1. As described above, the multiplier is arbitrarily chosen to be 1.1. If the comparison is true, the software will branch off to software block 76R wherein the CPU 38 is instructed to send a digital signal to the SSR 44 to close contact 45R to activate the PV motor 46 in the reverse flow mode, so that cold air is forced into the building. From software block 76R, the software then loops back to block 62. If the comparison is not true, the software will branch off to software block 78 wherein the CPU 38 is instructed to send a digital signal to the SSR 44 to open contact 45R to prevent the operation of the PV motor 46. From software block 78, the software then loops back to block 62.

In software block 82, the software compares the current indoor temperature to check if it is less than the outdoor temperature by a fixed multiplier which is less than 1. In this description, the multiplier is arbitrarily chosen to be 0.95 but it could be any value which will optimize the operation of the PV. If the comparison is not true, the software will branch off to software block 76R wherein the CPU 38 is instructed to send a digital signal to the SSR 44 to close contact 45R to activate the PV motor 46 in the reverse flow, mode so that cold air is forced into the building. If the comparison is true, the software will branch off to software block 78 wherein the CPU 38 is instructed to send a digital signal to the SSR 44 to open contact 45R to cease the operation of the PV motor 46. From software block 78, the software then loops back to block 62.

Returning back to software block 70, the software compares the current date with the winter season starting and ending dates. If true, the software proceeds to software block 72; else it proceeds back to software block 62. In software block 72, the software compares the time to check if the current time is within the default or user input limits of the daytime. If true, the software proceeds to software block 100, else it returns to software block 62. In software block 100, the software checks to see if the PV is on or off. If the PV is off, the software branches to block 74, otherwise it branches off to block 84. In block 74, the software compares the current indoor temperature to check if it is less than the winter daytime temperature set-point and also if it is less than the outdoor temperature by a fixed multiplier which is less than 1. In this case, the multiplier is arbitrarily chosen to be 0.9. If the comparison is true, the software will branch off to software block 76R wherein the CPU 38 is instructed to send a digital signal to the SSR 44 to close contact 45R to activate the PV motor 46 in the reverse flow mode so that warmer outside air is forced into the cold building. If the comparison is not true, the software will branch off to software block 78 wherein the CPU 38 is instructed to send a digital signal to the SSR 44 to open contact 45R to prevent the operation of the PV motor 46. From software block 78, the software then loops back to block 62.

In software block 84, the software compares the current indoor temperature to check if it is greater than the outdoor temperature by a fixed multiplier which is less than or equal to 1. In this case, the multiplier is arbitrarily chosen to be 0.95 but it could be any value which will optimize the operation of the PV. If the comparison is not true, the software will branch off to software block 76R wherein the CPU 38 is instructed to send a digital signal to the SSR 44 to close contact 45R to activate the PV motor 46 in the reverse flow mode so that warm outdoor air is forced into the cold building. If the comparison is true, the software will branch off to software block 78 wherein the CPU 38 is instructed to send a digital signal to the SSR 44 to open contact 45R to cease the operation of the PV motor 46. From software block 78, the software then loops back to block 62 where it re-iterates the loop.

The present invention and its operation, as described above, enables the building to be maintained at a more comfortable level during the summer season than is possible with contemporary power ventilator systems. The present invention does so by cooling down the building sufficiently at night-time during the summer season so that the building is maintained at a comfortable temperature for a longer period during the day. This reduces the energy requirements for air-conditioning the building during the hot summer day. The present invention also enables the use of warmer winter daytime outdoor air to heat up the inside of the building during winter days. This reduces the space-heating requirements of the building during cold winter days.

DESCRIPTION AND OPERATION—ALTERNATIVE EMBODIMENTS

The preferred embodiment described above uses a CPU and software to control the operation of the power ventilator. However the operation of the present invention could also be performed by other electro-mechanical devices like electro-mechanical relays and electrical or mechanical clocks. However, the alternative embodiment is likely to be more complicated and expensive than the preferred CPU based system described above.

The invention could also be carried out by manually monitoring indoor and outdoor temperatures and then manually switching the power ventilator on and off in accordance with predetermined criteria. However, such an approach has obvious disadvantages like lack of diligence on the part of the operator.

The preferred embodiment described above uses a reverse flow power ventilator for exchanging air between the indoors and outdoors of the building. However, the present invention can also be satisfactorily practiced, at the expense of lower efficiency of operation, by using a normal uni-directional flow power ventilator only which will either force air into the building or suck air out of the building. However, the efficiency of such an approach is likely to be lower than that achievable with the use of a bi-directional power ventilator.

The algorithms, used in the preferred embodiment described above, for determining the actions to be taken by action blocks 68 and 74 are based upon simple conditional on-off criteria wherein the power ventilator only switches on when the indoor or outdoor temperatures differs by a percentage chosen as a multiplier. However, the criteria for switching on or switching off the power ventilator could also be constant or variable differences between the indoor, outdoor and set-point temperatures. The criteria could also be a simple comparison of the indoor and outdoor temperatures to the set-points or to each other. In practice, this criteria may cause a constant cycling of the PV. More sophisticated algorithms could also be used which could be based upon advanced mathematical operations like the trends of the indoor/outdoor temperatures or the difference between the indoor and the outdoor temperatures. In trend control, the algorithms could check the rate at which the indoor and outdoor temperatures are rising and falling in order to pick out the optimum point at which to switch on or switch off the power ventilator. In difference control, the algorithm could monitor the differences between the indoor and outdoor temperatures in order to determine the optimum point at which the power ventilator should be turned on or off. All such modes of operation to optimize the operation of the present invention can be readily determined and implemented with a little bit of experimentation. The invention is also adaptable to more sophisticated algorithms which use artificial intelligence methods like neural networks to further optimize the operation of the power ventilator.

The present invention could also be used in modern homes which are controlled by personal computer or other such computerized systems. In this case, the analytical and control functions of the microprocessor could be performed by the personal computer and the software could reside on magnetic media on the hard drive or the floppy drive of the computer rather than on the ROM as described herein. The personal computer could also be used to monitor and report the performance of the ventilator. The ventilator could also be used as a part of a distributed control system in factories or commercial buildings or any other place where such control systems are used. All such embodiments would fall within the scope of the present invention.

SUMMARY, RAMIFICATIONS, AND SCOPE

Accordingly, the reader will see that the present invention can be used to reduce the air-conditioning energy requirements of a building during hot summer days and the space heating energy requirements of the building during cold winter days. The savings in energy for air-conditioning during summer time will be greater than that achievable by CPVs which only operate during the day-time after the building has already heated up because of solar radiation. The savings in energy for space-heating during winter days is greater than that achievable by CPVs which currently do not operate in this mode. The present invention also can be used in modern computer controlled buildings or homes so that the overall energy usage of the building can be closely monitored and optimized.

It may be understood that the invention described herein may be embodied in other specific forms without separating from its spirit or central characteristics. The present examples and embodiments given in this description, therefore, are to be considered in all respects as illustrative and not restrictive, and the invention is not to be limited to the details given here.

I claim:

1. An energy conservation apparatus for providing temperature responsive ventilation in a building, said building having electric power supply means and at least one temperature control output device in operative connection with said power supply means for exchanging air between the indoor and outdoor of a building, said apparatus being electrically interposed between said power supply means and said output device for controlling the transmission of electricity to said output device, said energy conservation apparatus comprising:

a first temperature sensor for reading the temperature of air outside the building;

a second temperature sensor for reading the temperature of air inside the building;

an electronic controller for operating the temperature control output device, said controller including;

a clock means for determining real time;

event memory means for storing a plurality of time schedules for real-time control of the output device;

memory means for storing an acceptable indoor temperature set-point for each said time schedule;

program memory means for storing a set of program instructions, said program instructions including predetermined operational criteria for each said time schedule;

program means responsive to said set of stored program instructions for:

obtaining real-time from said clock means;

obtaining said time schedule from said event memory means;

reading a outdoor temperature from said first temperature sensor;

reading a indoor temperature from said second temperature sensor;

comparing said real-time with each said time schedule to determine if said real-time falls within said time schedule; and comparing the read indoor temperature, the read outdoor temperature and the said indoor temperature set-point in accordance with said operational criteria associated with the selected said time schedule to switch on or switch off the temperature control output device.

2. The energy conservation apparatus of claim 1 wherein said schedule is a summer day-time schedule and said pre-determined operational criteria for said summer day-time schedule comprises:

program instructions to switch on the temperature control output device when the read indoor temperature is greater than said indoor temperature set-point associated with said summer day-time schedule and the read indoor temperature is at least greater than the read outdoor temperature; and program instructions to switch off the temperature control output device when the read indoor temperature is at least less than the read outdoor temperature.

3. The energy conservation apparatus of claim 1 wherein said schedule is a summer night-time schedule and said pre-determined operational criteria for said summer night-time schedule comprises:

program instructions to switch on the temperature control output device when the read indoor temperature is greater than said indoor temperature set-point associated with said summer night-time schedule and the read indoor temperature is at least greater than the read outdoor temperature; and program instructions to switch off the temperature control output device when the read indoor temperature is at least less than the read outdoor temperature.

4. The energy conservation apparatus of claim 1 wherein said schedule is a winter day-time schedule and said pre-determined operational criteria for said winter day-time schedule comprises:

program instructions to switch on the temperature control output device when the read indoor temperature is less than said indoor temperature set-point associated with said winter day-time schedule and the read indoor temperature is at least less than the read outdoor temperature; and program instructions to switch off the temperature control output device when the read indoor temperature is at least greater than the read indoor temperature at which the temperature control output device was switched on.

5. The energy conservation apparatus of claim 1 wherein said temperature control output device comprises a uni-directional flow ventilation fan.

6. The energy conservation apparatus of claim 1 wherein said temperature control output device comprises a bi-directional flow ventilation fan.

7. The energy conservation apparatus of claim 6 wherein said schedule is a summer night-time schedule and said pre-determined operational criteria for said summer night-time schedule comprises:

program instructions to switch on said ventilation fan in the reverse flow mode when the read indoor temperature is greater than said indoor temperature set-point associated with said summer night-time schedule and the read indoor temperature is at least greater than the read outdoor temperature; and program instructions to switch off the temperature control output device when the read indoor temperature is at least less than the read outdoor temperature.

8. The energy conservation apparatus of claim 6 wherein said schedule is a winter day-time schedule and said predetermined operational criteria for said winter day-time schedule comprises:

program instructions to switch on said ventilation fan in the reverse flow mode when the read indoor temperature is less than said indoor temperature set-point associated with said winter day-time schedule and the read indoor temperature is at least less than the read outdoor temperature; and program instructions to switch off the temperature control output device when the read indoor temperature is at least greater than the read indoor temperature at which the temperature control output device was switched on.

9. An energy conservation apparatus for providing temperature responsive ventilation in a building, said building having electric power supply means and at least one temperature control output device in operative connection with said power supply means for exchanging air in the building, said apparatus being electrically interposed between said power supply means and said output device for controlling the transmission of electricity to said output device, said energy conservation apparatus comprising:

a first temperature sensor for reading the temperature of air outside the building;

a second temperature sensor for reading the temperature of air outside the building;

an electronic controller for operating the temperature control output device, said controller including;

a clock means for determining real time;

event memory means for storing a summer night-time schedule for real-time control of the output device;

memory means for storing an acceptable indoor temperature set-point for said summer night-time schedule;

program memory means for storing a set of program instructions, said program instructions including operational instructions to switch on the temperature control output device when the read indoor temperature is greater than said indoor temperature set-point associated with said summer night-time schedule and the read indoor temperature is at least greater than the read outdoor temperature and operational instructions to switch off the temperature control output device when the read indoor temperature is at least less than the read outdoor temperature;

program means responsive to said set of stored program instructions for:

obtaining real-time from said clock means;

obtaining said summer night-time schedule from said event memory means;

reading a outdoor temperature from said first temperature sensor;

reading a indoor temperature from said second temperature sensor;

comparing said real-time with each said summer night-time schedule to determine if said real-time falls within said summer night-time schedule; and comparing the read indoor temperature, the read outdoor temperature and the said indoor temperature set-point in accordance with said operational instructions to switch on or switch off the temperature control output device.

10. The energy conservation apparatus of claim 9 wherein said temperature control output device comprises a unidirectional flow ventilation fan.

11. The energy conservation apparatus of claim 9 wherein said temperature control output device comprises a bi-directional flow ventilation fan.

12. The energy conservation apparatus of claim 11 wherein said program instructions include operational instructions to switch on said bi-directional flow ventilation fan in the reverse flow mode.

13. A method of conserving energy in a building having electric power supply means and at least one temperature control output device for exchanging air between the indoor and outdoor of a building, said method comprising the steps of:

reading the temperature of air outside the building;

reading the temperature of air inside the building;

providing means for switching on or switching off the temperature control output device in accordance with pre-determined time schedules and pre-determined operational criteria corresponding to said pre-determined time schedule;

determining real-time;

comparing said real-time to said pre-determined time schedule to determine if said real-time falls within said predetermined time schedule;

comparing the read indoor and the read outdoor temperatures in accordance with said predetermined operational criteria if said real-time fails within said predetermined time schedule; and switching on or switching off the temperature output device in accordance with the results of said comparison of the read indoor temperature and the read outdoor temperature.

14. The energy conservation method of claim 13 wherein said schedule is a summer day-time schedule and said pre-determined operational criteria for said summer day-time schedule comprises:

program instructions to switch on the temperature control output device when the read indoor temperature is greater than an acceptable indoor temperature value associated with said summer day-time schedule and the read indoor temperature is at least greater than the read outdoor temperature; and program instructions to switch off the temperature control output device when the read indoor temperature is at least less than the read outdoor temperature.

15. The energy conservation method of claim 13 wherein said schedule is a summer night-time schedule and said pre-determined operational criteria for said summer night-time schedule comprises:

program instructions to switch on the temperature control output device when the read indoor temperature is greater than an acceptable indoor temperature value associated with said summer night-time schedule and the read indoor temperature is at least greater than the read outdoor temperature; and program instructions to switch off the temperature control output device when the read indoor temperature is at least less than the read outdoor temperature.

16. The energy conservation method of claim 13 wherein said schedule is a winter day-time schedule and said pre-determined operational criteria for said winter day-time schedule comprises:

program instructions to switch on the temperature control output device when the read indoor temperature is less than an acceptable indoor temperature value associated with said winter day-time schedule and the read indoor temperature is at least less than the read outdoor temperature; and program instructions to switch off the temperature control output device when the read indoor temperature is at least greater than the read indoor temperature at which the temperature control output device was switched on.

17. The energy conservation method of claim 13 wherein said temperature control output device comprises a uni-directional flow ventilation fan.

18. The energy conservation method of claim 13 wherein said temperature control output device comprises a bi-directional flow ventilation fan.

19. The energy conservation method of claim 18 wherein said schedule is a summer night-time schedule and said pre-determined operational criteria for said summer night-time schedule comprises:

program instructions to switch on said ventilation fan in the reverse flow mode when the read indoor temperature is greater than an acceptable indoor temperature value associated with said summer night-time schedule and the read indoor temperature is at least greater than the read outdoor temperature; and program instructions to switch off the temperature control output device when the read indoor temperature is at least less than the read outdoor temperature.

20. The energy conservation method of claim 18 wherein said schedule is a winter day-time schedule and said pre-determined operational criteria for said winter day-time schedule comprises:

program instructions to switch on said ventilation fan in the reverse flow mode when the read indoor temperature is less than an acceptable indoor temperature value associated with said winter day-time schedule and the read indoor temperature is at least less than the read outdoor temperature; and program instructions to switch off the temperature control output device when the read indoor temperature is at least greater than the read indoor temperature at which the temperature control output device was switched on.

* * * * *